US012752391B2

(12) United States Patent
Shin et al.

(10) Patent No.: US 12,752,391 B2
(45) Date of Patent: Oct. 6, 2026

(54) SUBSTRATE POLISHING APPARATUS

(71) Applicant: KCTECH CO., LTD., Gyeonggi-do (KR)

(72) Inventors: Sung Ho Shin, Gyeonggi-do (KR); Hee Cheul Jung, Seoul (KR); Soo Ho Kim, Gyeonggi-do (KR)

(73) Assignee: KCTECH CO., LTD., Gyeonggi-do (KR)

( * ) Notice: Subject to any disclaimer, the term of this patent is extended or adjusted under 35 U.S.C. 154(b) by 517 days.

(21) Appl. No.: 18/453,322

(22) Filed: Aug. 22, 2023

(65) Prior Publication Data

US 2024/0286243 A1 Aug. 29, 2024

(30) Foreign Application Priority Data

Feb. 28, 2023 (KR) ..... 10-2023-0027061
Apr. 17, 2023 (KR) ..... 10-2023-0049910

(51) Int. Cl.
*B24B 37/015* (2012.01)

(52) U.S. Cl.
CPC ..... *B24B 37/015* (2013.01)

(58) Field of Classification Search
CPC ..... B24B 3/00; B24B 3/005; B24B 3/015; B24B 57/02
See application file for complete search history.

(56) References Cited

U.S. PATENT DOCUMENTS 11,926,018 B2 * 3/2024 Ito ..... B24B 37/013
2005/0221724 A1 * 10/2005 Terada ..... B24B 37/04 451/41
2011/0159782 A1 * 6/2011 Sone ..... B24B 37/015 451/7
2012/0220196 A1 * 8/2012 Maruyama ..... B24B 37/04 451/7
2014/0273753 A1 * 9/2014 Matsuo ..... B24B 37/005 451/6
2018/0290263 A1 * 10/2018 Sotozaki ..... B24B 57/02
2019/0039203 A1 * 2/2019 Toriyabe ..... B24B 53/017
2023/0286108 A1 * 9/2023 Kwon ..... B24B 53/017

* cited by examiner

*Primary Examiner* — C. A. Rivera
(74) *Attorney, Agent, or Firm* — JCIPRNET

(57) ABSTRACT

Provided is a substrate polishing apparatus. The substrate polishing apparatus includes a carrier configured to grip a substrate, a polishing pad configured to polish a surface to be polished of the substrate gripped by the carrier while rotating, and a temperature control assembly configured to control a temperature of the polishing pad, and the temperature control assembly includes Deionized water (DIW) spraying module configured to spray DIW toward the polishing pad and a guide vane configured to guide at least a portion of the DIW sprayed from the DIW spraying module to an outside of the polishing pad.

9 Claims, 10 Drawing Sheets

SUBSTRATE POLISHING APPARATUS

CROSS-REFERENCE TO RELATED APPLICATIONS

This application claims the benefit of Korean Patent Application No. 10-2023-0027061 filed on Feb. 28, 2023, Korean Patent Application No. 10-2023-0049910 filed on Apr. 17, 2023, in the Korean Intellectual Property Office, the entire disclosures of which are incorporated herein by reference for all purposes.

BACKGROUND

1. Field of the Invention

One or more embodiments relate to a substrate polishing apparatus.

2. Description of the Related Art

In manufacturing a substrate, a chemical mechanical polishing (CMP) process, including polishing, buffing, and/or cleaning, is required. The CMP process of a substrate requires a process of polishing a surface to be polished of the substrate through a polishing pad. The CMP device includes a carrier that grips a substrate and a polishing pad for polishing a surface to be polished of the substrate. Furthermore, to efficiently perform polishing, it is required to control the temperature of a polishing pad to an appropriate temperature.

The above description has been possessed or acquired by the inventor(s) in the course of conceiving the present disclosure and is not necessarily an art publicly known before the present application is filed.

SUMMARY

Embodiments provide a substrate polishing apparatus that may reduce or prevent the dilution of slurry by Deionized water (DIW) when the slurry is sprayed onto a polishing pad.

Embodiments provide a substrate polishing apparatus that may spray a large amount of DIW by controlling the amount of DIW discharged from a polishing pad, or alternatively may effectively discharge slurry and particles used for polishing to the outside of the polishing pad.

According to an aspect, there is provided a substrate polishing apparatus including a carrier configured to grip a substrate, a polishing pad configured to polish a surface to be polished of the substrate gripped by the carrier while rotating, and a temperature control assembly configured to control a temperature of the polishing pad. The temperature control assembly includes a DIW spraying module configured to spray DIW toward the polishing pad and a guide vane configured to guide at least a portion of the DIW sprayed from the DIW spraying module to an outside of the polishing pad.

The temperature control assembly may include a slurry spraying module configured to spray slurry toward the polishing pad and a housing configured to accommodate the DIW spraying module and the slurry spraying module and to which one end portion of the guide vane is coupled.

One end portion of the guide vane may be coupled to the other surface opposite to one surface facing the carrier in the housing and the other end portion opposite to the one end portion extends toward an outer circumferential surface of the polishing pad.

The guide vane may include a wing area formed at the other end portion of the guide vane and curved in a rotational direction of the polishing pad.

The wing area may have a shape rounded with a predetermined curvature in the rotational direction of the polishing pad.

The guide vane may have a shape extending upward from the polishing pad.

The guide vane may include a curved area formed at a lower end portion of the guide vane facing an upper surface of the polishing pad.

The curved area may have a shape rounded with a predetermined curvature in a rotational direction of the polishing pad.

The curved area may have a shape bent at a predetermined angle in a rotational direction of the polishing pad.

The curved area may be formed of an elastic body including at least a portion of urethane, rubber, or silicon.

The temperature control assembly may include a height adjustment unit configured to raise or lower the guide vane to adjust a distance between the polishing pad and the guide vane.

The temperature control assembly may include an angle adjustment unit configured to tilt the guide vane to adjust an angle between the polishing pad and the guide vane.

The temperature control assembly may include a cleaning unit configured to clean the guide vane.

Additional aspects of example embodiments will be set forth in part in the description which follows and, in part, will be apparent from the description, or may be learned by practice of the disclosure.

According to embodiments, a substrate polishing apparatus may reduce or prevent dilution of slurry by DIW by efficiently discharging DIW to the outside of a polishing pad and may efficiently control the temperature of the polishing pad by spraying a large amount of DIW to the polishing pad.

According to embodiments, a substrate polishing apparatus may efficiently discharge slurry and particles used for polishing in addition to DIW to the outside of a polishing pad.

The effects of the substrate polishing apparatus are not limited to the above-mentioned effects, and other unmentioned effects can be clearly understood from the above description by those having ordinary skill in the technical field to which the present disclosure pertains.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Figure 1:
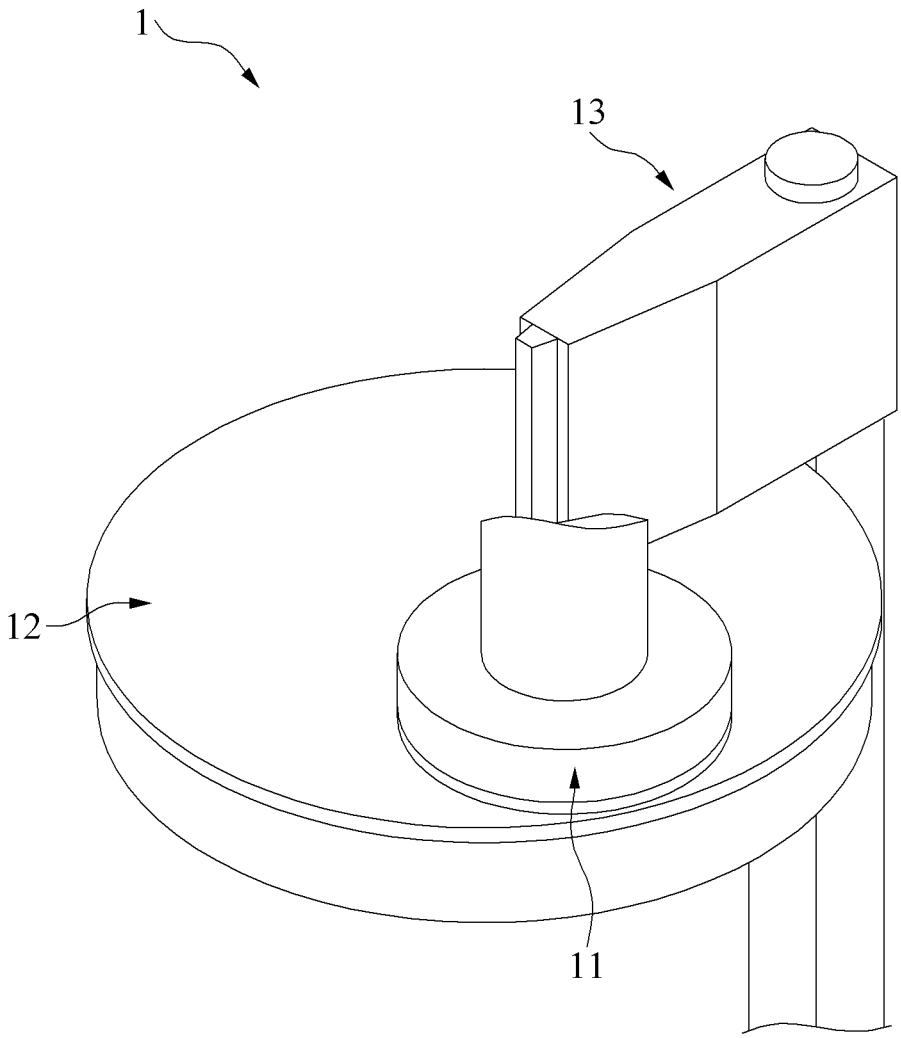
FIG. 1 is a perspective view illustrating a substrate polishing apparatus according to an embodiment.

Hereinafter, example embodiments will be described in detail with reference to the accompanying drawings. However, various alterations and modifications may be made to the embodiments. Here, the embodiments are not meant to be limited by the descriptions of the present disclosure. The embodiments should be understood to include all changes, equivalents, and replacements within the idea and the technical scope of the disclosure.

The terminology used herein is for the purpose of describing particular embodiments only and is not intended to be limiting. The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or groups thereof.

Unless otherwise defined, all terms including technical and scientific terms used herein have the same meaning as commonly understood by one of ordinary skill in the art to which the embodiments belong. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

When describing the embodiments with reference to the accompanying drawings, like reference numerals refer to like components and a repeated description related thereto will be omitted. In the description of example embodiments, detailed description of well-known related structures or functions will be omitted when it is deemed that such description will cause ambiguous interpretation of the present disclosure.

In addition, terms such as first, second, A, B, (a), (b), and the like may be used to describe components of the embodiments. These terms are used only for the purpose of discriminating one constituent element from another constituent element, and the nature, the sequences, or the orders of the constituent elements are not limited by the terms. When one constituent element is described as being "connected", "coupled", or "attached" to another constituent element, it should be understood that one constituent element can be connected or attached directly to another constituent element, and an intervening constituent element can also be "connected", "coupled", or "attached" to the constituent elements.

The same name may be used to describe an element included in the example embodiments described above and an element having a common function. Unless otherwise mentioned, the descriptions of the examples may be applicable to the following examples and thus, duplicated descriptions will be omitted for conciseness.

Figure 2:
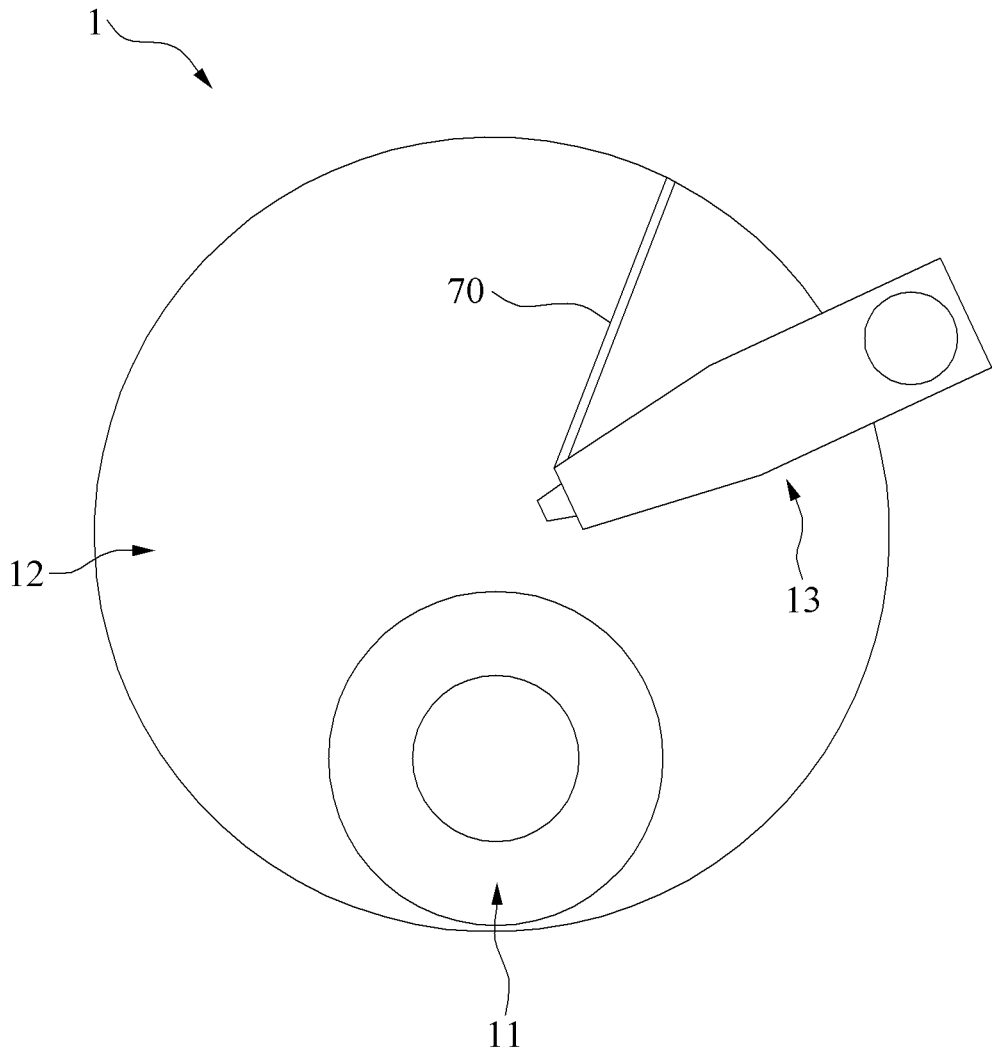
FIG. 2 is a plan view illustrating the substrate polishing apparatus according to an embodiment.

FIG. 1 is a perspective view illustrating a substrate polishing apparatus 1 according to an embodiment and FIG. 2 is a plan view illustrating the substrate polishing apparatus 1 according to an embodiment.

Referring to FIGS. 1 and 2, in an embodiment, the substrate polishing apparatus 1 may be used for a chemical mechanical polishing (CMP) process of a substrate. The substrate may be a silicon wafer for manufacturing a semiconductor device. However, the type of a substrate is not limited thereto. For example, a substrate may include glass for a flat panel display (FPD) device such as a liquid crystal display (LCD) or a plasma display panel (PDP).

In an embodiment, the substrate polishing apparatus 1 may polish a substrate. The substrate polishing apparatus 1 may include a carrier 11, a polishing pad 12, and a temperature control assembly 13.

In an embodiment, the carrier 11 may grip a substrate. For example, the carrier 11 may include a carrier head, a retainer ring, and a membrane. The carrier 11 may be translated and/or rotated while gripping the substrate.

In an embodiment, the polishing pad 12 may polish a surface to be polished of the substrate gripped by the carrier 11. The polishing pad 12 may be connected to a polishing platen (not shown) and rotated clockwise or counterclockwise.

In an embodiment, the temperature control assembly 13 may control the temperature of the polishing pad 12. For example, the temperature control assembly 13 may heat or cool a polishing surface of the polishing pad 12 by spraying temperature control fluid to the polishing surface of the polishing pad 12. The temperature control assembly 13 may rotate around one axis to swing on the upper side of the polishing pad 12. The temperature control assembly 13 may include a guide vane 70 to guide the discharge of the temperature control fluid.

Figure 3:
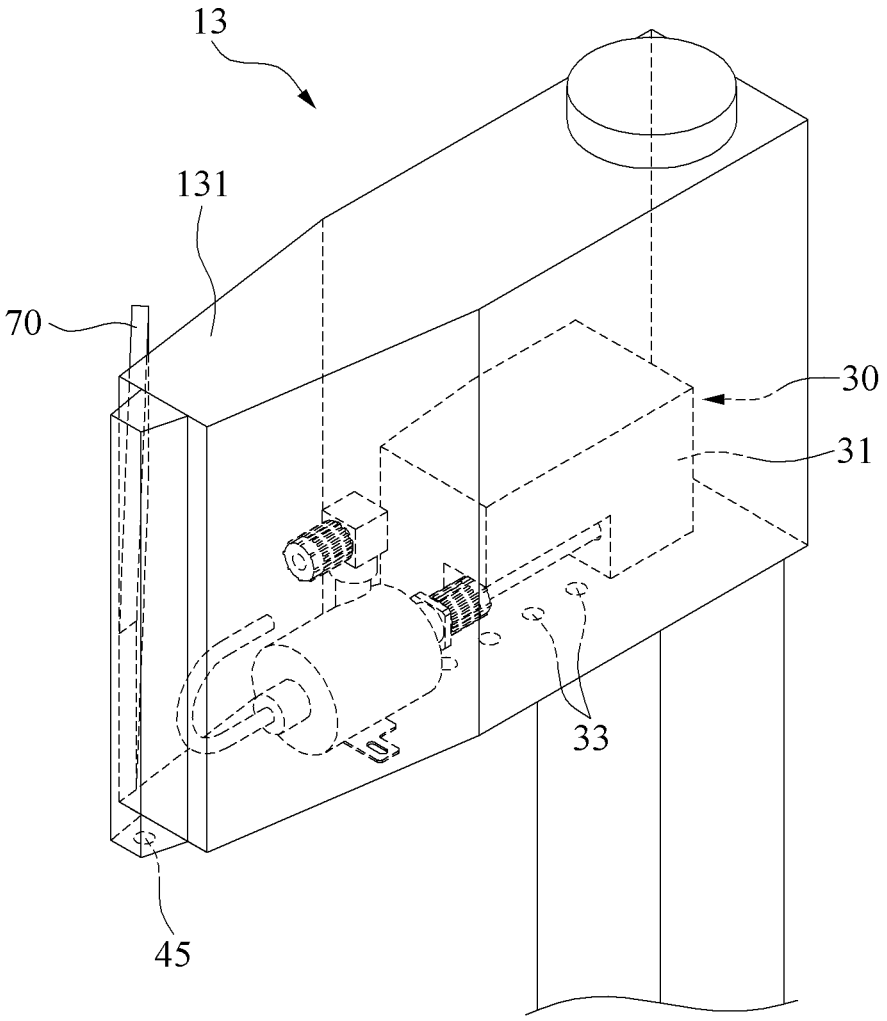
FIG. 3 is a perspective view illustrating a temperature control assembly according to an embodiment.
Figure 4:
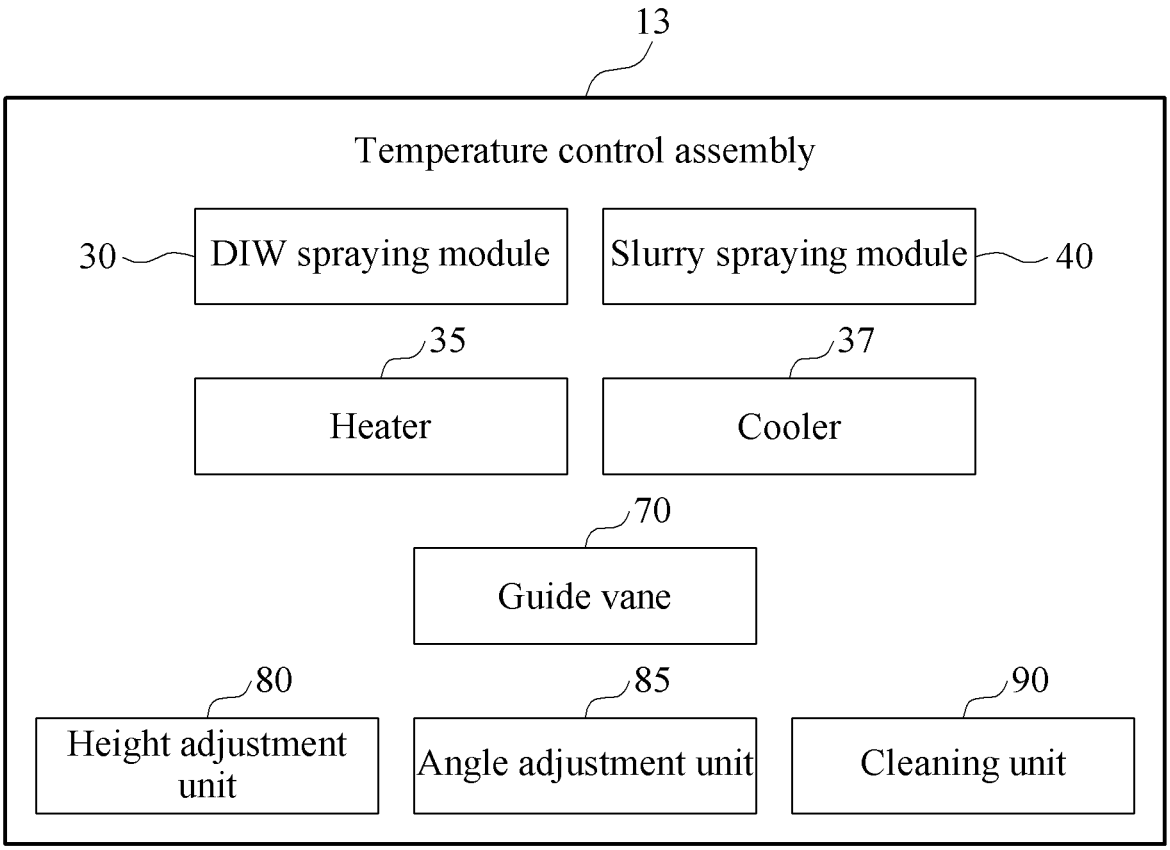
FIG. 4 is a block diagram illustrating the temperature control assembly according to an embodiment.

FIG. 3 is a perspective view illustrating the temperature control assembly 13 according to an embodiment and FIG. 4 is a block diagram illustrating the temperature control assembly 13 according to an embodiment.

Referring to FIGS. 3 and 4, according to an embodiment, the temperature control assembly 13 may include at least a portion of a Deionized water (DIW) spraying module 30, a slurry spraying module 40, and the guide vane 70.

In an embodiment, the temperature control assembly 13 may heat or cool the polishing surface of the polishing pad 12. The temperature control assembly 13 may include a housing 131 and accommodate various components to control the temperature of the polishing surface of the polishing pad 12.

In an embodiment, the housing 131 may form the exterior of the temperature control assembly 13. The housing 131 may be spaced apart from the upper side of the polishing pad 12. The housing 131 may provide a space in which various components are disposed. The housing 131 may rotate around one axis to swing on the upper side of the polishing pad 12.

In an embodiment, the temperature control assembly 13 may include a heater 35 and heat DIW or slurry. For example, the heater 35 may be a ceramic heater, a ruthenox heater, or a metal heater but is not limited thereto. The heater 35 may be a high-power heater to rapidly increase the temperature of the DIW.

In an embodiment, the temperature control assembly 13 may include a cooler 37 and cool DIW or slurry. The cooler 37 may be implemented as an air-cooled or water-cooled cooling module, or an electronic thermoelectric element.

In an embodiment, the DIW spraying module 30 may spray the heated or cooled DIW to control the temperature of the polishing pad 12. For example, the DIW spraying module 30 may spray the DIW heated by the heater 35 toward the polishing pad 12 to heat the polishing pad 12. The DIW spraying module 30 may be provided inside of the housing 131 and may spray DIW to a polishing surface through a DIW spraying hole 33. The DIW spraying module 30 may include a tank 31.

In an embodiment, the tank 31 may store DIW in a heated state. For example, DIW may be stored in the tank 31 in a heated state to 70 Celsius (° C.) to 90° C. Alternatively, for example, DIW may be in a state heated to 80° C. However, this is an example, and the temperature of the heated DIW is not limited thereto. The DIW stored in the tank 31 may be sprayed onto the polishing surface of the polishing pad 12 through a pump, a pipe (not shown), and/or a nozzle (not shown).

In an embodiment, the tank 31 may be provided inside of the housing 131. As the tank 31 is provided inside the housing 131 positioned adjacent to the polishing pad 12 on the upper side of the polishing pad 12, a short path for supplying the heated DIW that is stored in the tank 31 to the polishing pad 12 may be formed and accordingly, heat loss that may occur during a supply process may be minimized.

In an embodiment, the tank 31 may include an air vent line (not shown) to prevent breakage. The tank 31 may include a level sensor (not shown). By measuring the level of the DIW stored in the tank 31 through the level sensor, damage of the heater 35 and/or breakage of the pump may be prevented. The tank 31 may include a temperature sensor (not shown) to measure the temperature of the stored DIW. By measuring the temperature of the DIW stored in the tank 31 through the temperature sensor, a process temperature may be controlled. A valve to prevent DIW from flowing out may be provided at an outlet end portion of the pump. Controlling the amount of DIW sprayed through the DIW spraying hole 33 may be performed through table control based on experimental values.

In an embodiment, the DIW spraying module 30 may spray the heated DIW stored in the tank 31 to the polishing pad 12 to heat the polishing pad 12 before polishing on a substrate starts. Since DIW is stored in a preheated state in the tank 31, the DIW spraying module 30 may immediately spray the heated DIW to the polishing pad 12. Before starting polishing, since the ramp-up time required for heating DIW to be sprayed may be omitted or minimized, the total process time may be reduced by reducing the initial heating time. In addition, since DIW is stored in a preheated state in the tank 31, the total process time may be reduced by reducing the initial heating time as the heated DIW at a high flow rate is sprayed to the polishing pad 12 with a low output.

In an embodiment, the slurry spraying module 40 may spray slurry toward the polishing pad 12. The temperature control assembly 13 may heat slurry through the heater 35 or cool slurry through the cooler 37.

In an embodiment, the slurry spraying module 40 may control the temperature of the polishing pad 12 by spraying the heated slurry or the cooled slurry by the heater 35 or the cooler 37 toward the polishing pad 12. Although not shown in FIG. 3, the slurry spraying module 40 may be provided inside of the housing 131 and may spray slurry to a polishing surface through a slurry spraying hole 45.

For example, while polishing on a substrate is in progress, the slurry spraying module 40 may spray the heated or cooled slurry toward the polishing pad 12 to control the temperature of the polishing pad 12. For example, the temperature of slurry supplied to the polishing pad 12 while polishing on the substrate is in progress may be 0° C. to 80° C. However, this is an example, and the temperature of slurry is not limited thereto.

In an embodiment, the slurry spraying module 40 may spray the cooled slurry toward the polishing pad 12 to cool the polishing pad 12 after detecting the polishing endpoint for a substrate. For example, the temperature of the cooled slurry may be 0° C. However, this is an example, and the temperature of slurry is not limited thereto.

In an embodiment, the guide vane 70 may guide at least a portion of DIW sprayed from the DIW spraying module 30 to the outside of the polishing pad 12. However, the embodiment is not limited thereto, and the guide vane 70 may guide slurry sprayed from the slurry spraying module 40 and/or particles and residue remaining on the polishing pad 12 to the outside of the polishing pad 12.

In an embodiment, one end portion of the guide vane 70 may be connected to and supported in a partial area of the temperature control assembly 13. One end portion of the guide vane 70 may be connected to the outer circumferential surface of the housing 131, for example, the other surface opposite to one surface facing the carrier 11 in the housing 131, and the other end portion opposite to one end portion may extend in the outer circumferential surface direction of the polishing pad 12. However, the embodiment is not limited thereto, and the guide vane 70 may be connected to and supported by a separate support structure (not shown).

In an embodiment, the guide vane 70 may have a shape of a vane or a shape of a wall to control the flow of fluid. For example, one end portion of the guide vane 70 may extend toward the center of the polishing pad 12 and the other end portion opposite to the one end portion may extend toward the outer circumferential surface of the polishing pad 12.

In an embodiment, the temperature control assembly 13 may include at least a portion of a height adjustment unit 80, an angle adjustment unit 85, and a cleaning unit 90 to control or manage the guide vane 70. The height adjustment unit 80 and the angle adjustment unit 85 is described below with reference to FIGS. 7A, 7B, and 7C.

In an embodiment, the cleaning unit 90 may clean the guide vane 70. For example, the cleaning unit 90 may spray cleaning liquid toward a surface facing the housing 131 from the guide vane 70. After using the guide vane 70, slurry, particles, or other contaminants may adhere to the guide vane 70, secondary contamination on the polishing pad 12 may be caused, or scratches on the polishing pad 12 may occur. The cleaning unit 90 may clean the guide vane 70 so that contamination or scratches on the polishing pad 12 may be prevented from occurring.

Figure 5:
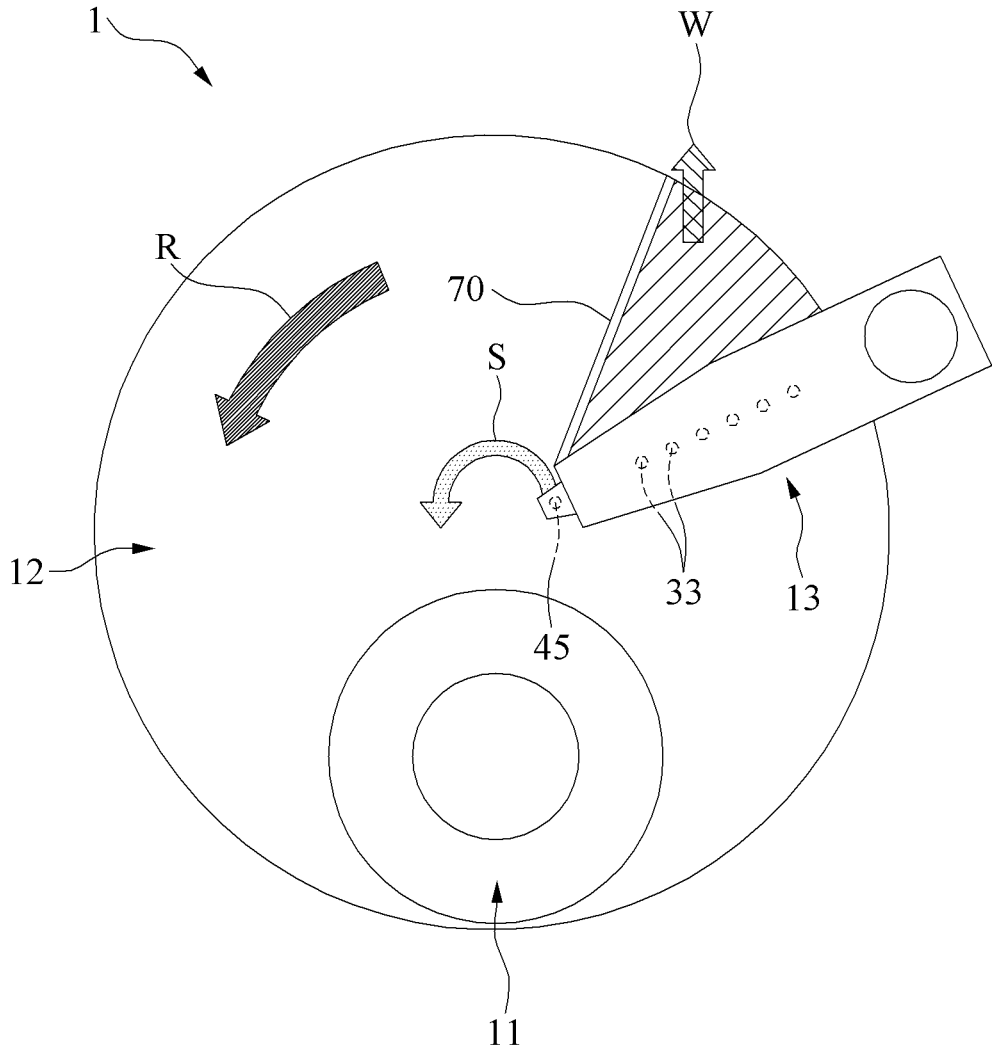
FIG. 5 is a plan view illustrating the substrate polishing apparatus according to an embodiment.

FIG. 5 is a plan view illustrating the substrate polishing apparatus 1 according to an embodiment.

Referring to FIG. 5, according to an embodiment, the guide vane 70 of the substrate polishing apparatus 1 may guide the discharge of DIW.

In FIG. 5, R schematically represents the rotation of the polishing pad 12, S schematically represents the flow of slurry sprayed from the slurry spraying hole 45, and W schematically represents the flow in which DIW sprayed from the DIW spraying hole 33 is guided by the guide vane 70.

In an embodiment, the guide vane 70 may guide the used DIW to the outside of the polishing pad 12 and the guide vane 70 may control the amount of DIW remaining in the polishing pad 12, a space in which the DIW flows, and the amount of DIW discharged from the polishing pad 12. For example, one end portion of the guide vane 70 may be connected to a position between the DIW spraying hole 33 and the slurry spraying hole 45 in the housing 131 and extend the outside of the polishing pad 12 so that a flow range of DIW may be controlled and the mixing of DIW and slurry may be reduced or prevented.

In an embodiment, the guide vane 70 may limit the flow range of DIW to a space between the housing 131 and the guide vane 70 and may reduce or prevent that the DIW flows in a discharge direction of slurry and dilutes the slurry.

For example, when rapid temperature control of the polishing pad 12 is required, the temperature control assembly 13 may spray a large amount of high-temperature or low-temperature DIW. In this case, slurry may be diluted by the large amount of DIW and the removal rate (RR) may decrease during polishing. However, when the amount of sprayed slurry increases to reduce dilution of the slurry, the cost may increase, the RR may change, or environmental pollution may be affected when the increased slurry is not properly treated.

In an embodiment, when the amount of DIW sprayed onto the polishing pad 12 by the temperature control assembly 13 increases, the guide vane 70 may discharge the DIW to the outside of the polishing pad 12 by efficiently guiding DIW used for cooling or heating to the outside of the polishing pad 12. Through the guide vane 70, the substrate polishing apparatus 1 may efficiently discharge DIW even when a large amount of DIW is sprayed, improve the temperature control effect, prevent slurry from being diluted, and prevent the RR from being reduced. However, the embodiment is not limited thereto, and the guide vane 70 may assist the discharge of the used slurry, particles, or residue by guiding the used slurry, particles, or residue in addition to the DIW to the outside of the polishing pad 12.

Figure 6:
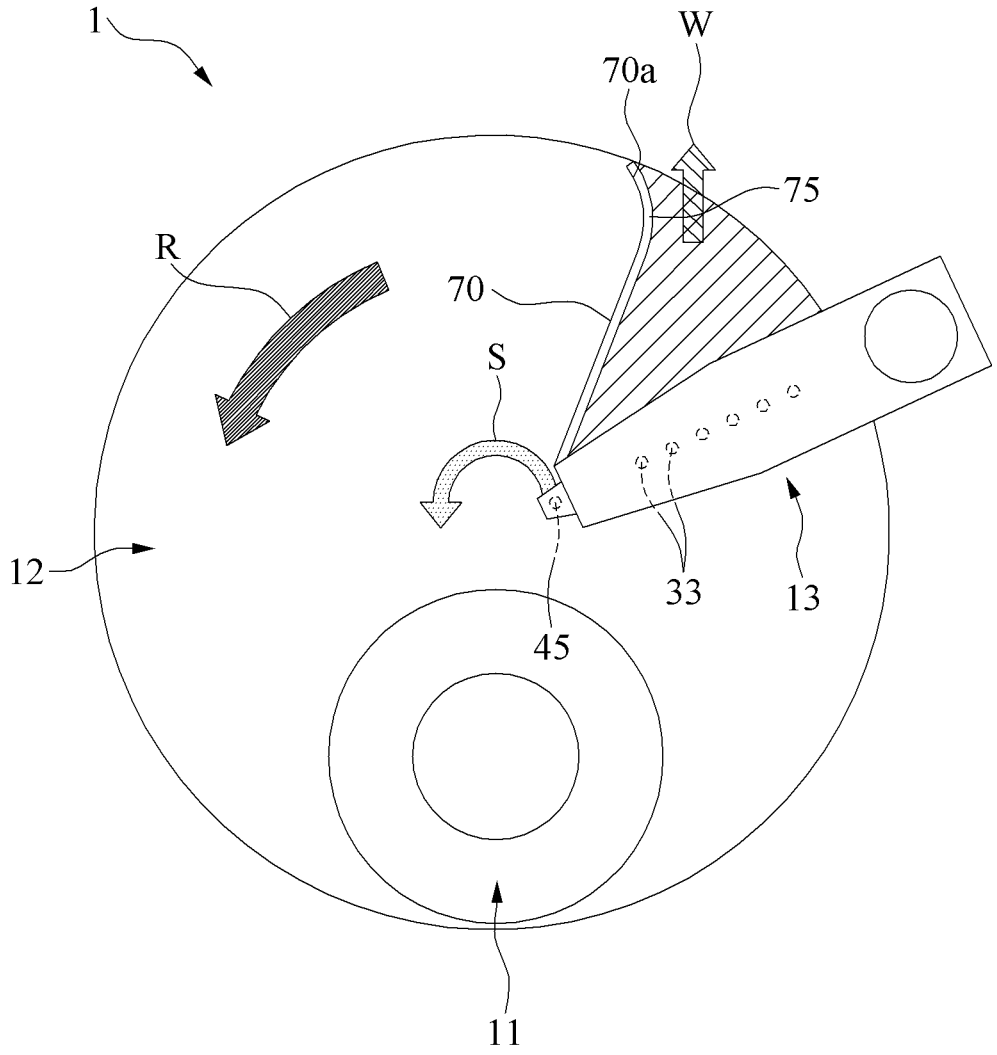
FIG. 6 is a plan view illustrating the substrate polishing apparatus according to an embodiment.

FIG. 6 is a plan view illustrating the substrate polishing apparatus 1 according to an embodiment.

Referring to FIG. 6, according to an embodiment, the guide vane 70 may include a wing area 75.

In an embodiment, the wing area 75 may be formed at an end portion extending to the outside of the polishing pad 12, that is, at the other end portion 70*a*, in the guide vane 70. The wing area 75 may guide DIW to be discharged the outside of the polishing pad 12 smoothly. The wing area 75 may have a curved shape in the rotational direction of the polishing pad 12.

In an embodiment, the wing area 75 may have a shape rounded with a predetermined curvature in the rotational direction of the polishing pad 12. The wing area 75 may smoothly guide the discharge of DIW through the rounded shape.

Although in FIG. 6 the wing area 75 is provided to be limitedly formed in a partial area of the end portion of the guide vane 70. an actual implementation is not limited thereto. For example, the guide vane 70 may have a range of 30% to 70% of the length from one end portion to the other end portion of the guide vane 70 as the wing area 75, or substantially the entire area of the guide vane 70 may have a curved shape like the wing area 75.

Figure 7A:
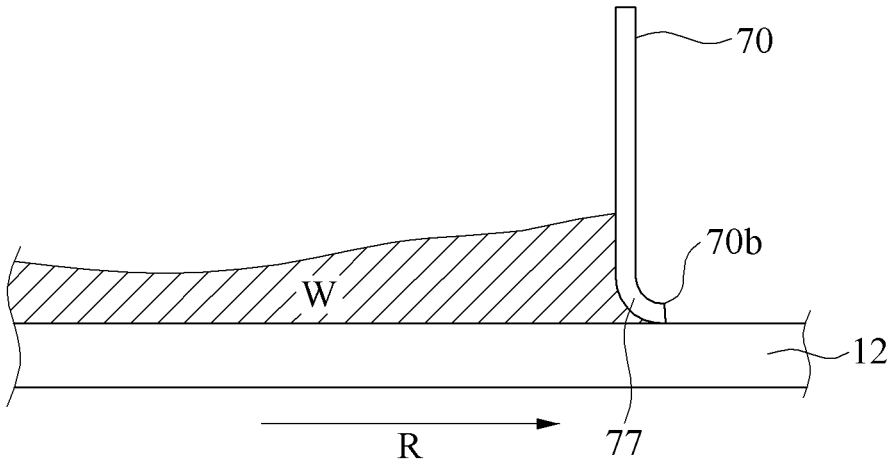
FIG. 7A is a side view illustrating the substrate polishing apparatus according to an embodiment.
Figure 7B:
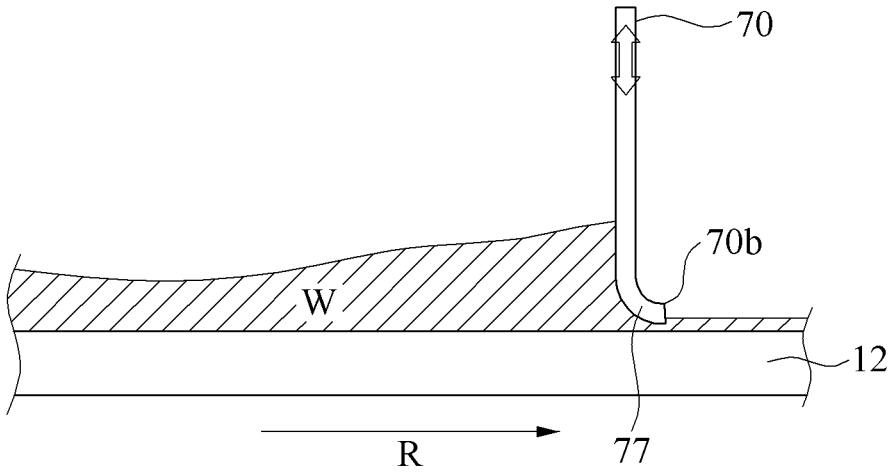
FIG. 7B is another side view illustrating the substrate polishing apparatus according to an embodiment.
Figure 7C:
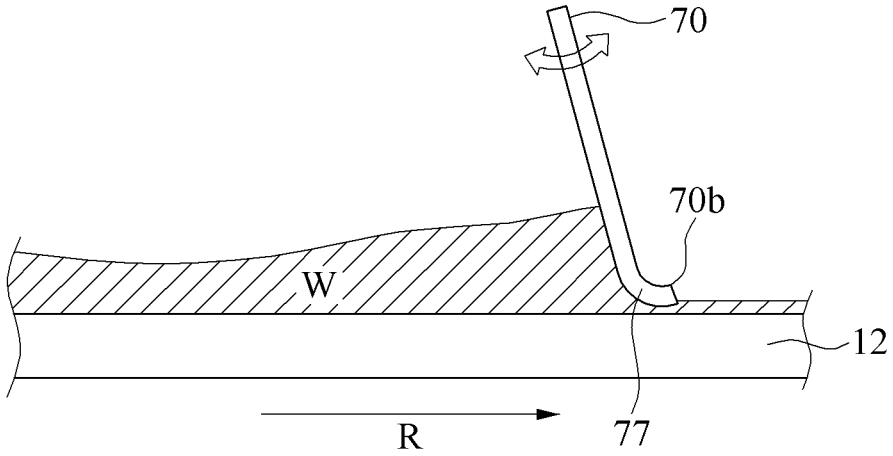
FIG. 7C is another side view illustrating the substrate polishing apparatus according to an embodiment.

FIG. 7A is a side view illustrating the substrate polishing apparatus 1 according to an embodiment, FIG. 7B is another side view illustrating the substrate polishing apparatus 1 according to an embodiment, and FIG. 7C is another side view illustrating the substrate polishing apparatus 1 according to an embodiment.

Referring to FIGS. 7A, 7B, and 7C, according to an embodiment, the guide vane 70 may include a curved area 77.

In an embodiment, the guide vane 70 may have a shape extending upwardly from the polishing pad 12. The guide vane 70 may limit the range in which DIW flows by the rotation of the polishing pad 12. At least a portion of DIW may heat or cool the polishing pad 12 while flowing in a space between the guide vane 70 and the housing 131 and may be discharged by being guided to the outside of the polishing pad 12 by the guide vane 70.

In an embodiment, the curved area 77 may be provided at a lower end portion 70*b* of the guide vane 70. For example, the curved area 77 may be formed at an end portion facing the upper surface (i.e., a polishing surface) of the polishing pad 12 from the guide vane 70.

In an embodiment, the curved area 77 may have a shape rounded with a predetermined curvature in the rotational direction of the polishing pad 12. The curved area 77 may make the polishing pad 12 and the guide vane 70 smoothly contact each other. In addition, the curved area 77 may induce DIW passing between the polishing pad 12 and the guide vane 70 to flow smoothly.

Although not shown in the drawing, the curved area 77 may have a shape bent at a predetermined angle in the rotational direction of the polishing pad 12. For example, the curved area 77 may be formed in the form of a line bent once or may be formed in the form of a triangle or quadrangle bent multiple times. Depending on the form of the curved area 77, DIW may be induced to flow smoothly.

In an embodiment, the curved area 77 may be formed of an elastic body. For example, the curved area 77 may include at least a portion of urethane, rubber, or silicone. The curved area 77 of the elastic body may reduce or prevent damage caused by contact with the polishing pad 12 and improve the sealing force to control the flow range of DIW.

As shown in FIG. 7B, a distance between the guide vane 70 and the polishing pad 12 may be adjusted. The height adjustment unit 80 may raise or lower the guide vane 70 to adjust the distance between the polishing pad 12 and the guide vane 70. When the guide vane 70 is raised by the height adjustment unit 80, DIW may pass through a predetermined separation space between the polishing pad 12 and the guide vane 70 and may spread to the entire area of the polishing pad 12.

As shown in FIG. 7C, the angle of the guide vane 70 with the polishing pad 12 may be adjusted. The angle adjustment unit 85 may tilt the guide vane 70 to adjust the angle between the polishing pad 12 and the guide vane 70. The width of the space between the guide vane 70 and the housing 131 may be adjusted by the angle adjustment unit 85. Alternatively, a predetermined separation space between the polishing pad 12 and the guide vane 70 may be formed by the angle adjustment unit 85, and DIW may pass therethrough.

Figure 8:
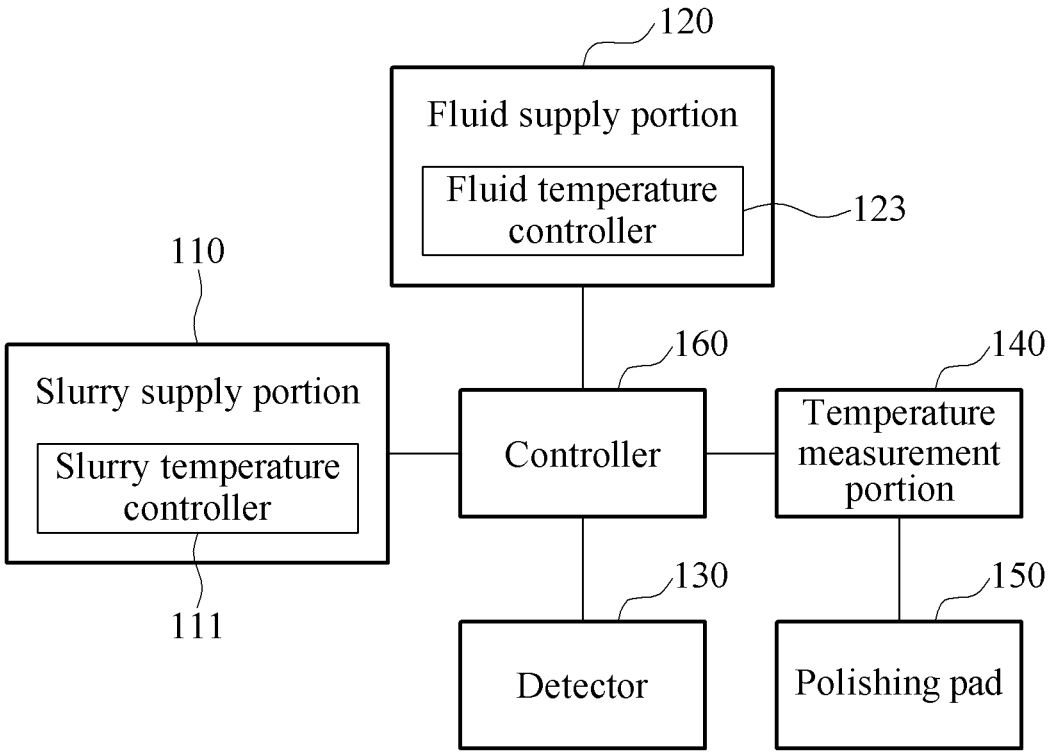
FIG. 8 is a block diagram illustrating the substrate polishing apparatus according to an embodiment.

FIG. 8 is a block diagram illustrating the substrate polishing apparatus 1 according to an embodiment.

Referring to FIG. 8, according to an embodiment, the substrate polishing apparatus 1 may include at least a portion of a carrier head (e.g., the carrier 11 of FIGS. 1 and 2), a polishing pad 150 (e.g., the polishing pad 12 of FIGS. 1 and 2), a slurry supply portion 110 (e.g., the slurry spraying module 40 of FIG. 4), a fluid supply portion 120, a detector 130, a temperature measurement portion 140, and a controller 160.

In an embodiment, the carrier head may grip a substrate. For example, the carrier head may grip the substrate by applying negative pressure to the substrate. In a state in which the carrier head grips the substrate, a surface to be polished of the substrate may face the lower portion of the carrier head to contact the polishing pad 150.

In an embodiment, the carrier head may move with respect to the polishing pad 150. The height of the carrier head with respect to the polishing pad 150 may be adjusted. The carrier head may move on a plane parallel to a surface of the polishing pad 150. As the carrier head moves relative to the polishing pad 150, the substrate gripped by the carrier head may move on the polishing pad 150.

In an embodiment, the carrier head may rotate while gripping a substrate. For example, the carrier head may rotate around an axis perpendicular to the surface of the polishing pad 150. The carrier head may polish the substrate by pressing the gripped substrate in contact with the polishing pad 150 or by rotating the gripped substrate in contact with the polishing pad 150.

In an embodiment, the polishing pad 150 may polish a surface to be polished of a substrate. The polishing pad 150 may be disposed on the upper portion of a polishing platen. In the process of polishing a substrate, the polishing pad 150 may physically abrade a surface of the substrate by contacting the surface to be polished of the substrate.

In an embodiment, the polishing pad 150 may rotate around an axis perpendicular to the ground. For example, the polishing pad 150 may be rotated by the rotation of a polishing platen. In an embodiment, the surface temperature of the polishing pad 150 may be controlled.

In an embodiment, the slurry supply portion 110 may supply the slurry S to the surface of the polishing pad 150. In the process of polishing a substrate, the slurry S may be supplied between a contact surface of the substrate and the polishing pad 150 so that materials of the surface of the substrate may be chemically treated while physically polishing the surface of the substrate.

In an embodiment, the slurry supply portion 110 may control the temperature of the slurry S supplied to the polishing pad 150. For example, the slurry supply portion 110 may include a slurry temperature controller 111 to control the temperature of the slurry S. The slurry temperature controller 111 may heat or cool the slurry S to control the temperature of the slurry S to a set range. The temperature range of the slurry S may be set differently according to the polishing profile of the substrate.

In an embodiment, the fluid supply portion 120 may supply fluid to the surface of the polishing pad 150. One or more fluid supply portions 120 may be provided. When a plurality of fluid supply portions 120 is provided, each of the fluid supply portions 120 may supply fluid to the surface of the polishing pad 150. In this case, each of the fluid supply portions 120 may supply fluids of different types, fluids having different phases, or fluids having different temperatures.

For example, the fluid supply portion 120 may include a gas supply portion that sprays fluid in a gaseous state and a liquid supply portion that sprays fluid in a liquid state. In an embodiment, the fluid sprayed by the fluid supply portion 120 may be, for example, DIW.

In an embodiment, the fluid supply portion 120 may control the temperature of the polishing pad 150 through the sprayed fluid. For example, a fluid temperature controller 123 may control the temperature of the fluid sprayed onto the surface of the polishing pad 150 through the fluid supply portion 120. The fluid supply portion 120 may spray fluids having different temperatures to the surface of the polishing pad 150 depending on polishing a substrate.

In an embodiment, the detector 130 may detect a surface state of a substrate. For example, the detector 130 may detect whether the thickness of the substrate reaches a set target thickness by detecting the thickness of the substrate according to the degree of polishing.

In an embodiment, the detector 130 may detect whether the polishing endpoint of a substrate is reached depending on a surface state of the substrate. In an embodiment, the detector 130 may detect the degree of polishing of the substrate in various ways (e.g., optical measurement, motor torque measurement, Eddy current measurement, etc.).

In an embodiment, the temperature measurement portion 140 may measure the temperature of the polishing pad 150. In an embodiment, the temperature of the polishing pad 150 may be measured while polishing of a substrate is in process. In an embodiment, the temperature measurement portion 140 may measure the temperature of the polishing pad 150 in various ways. For example, the temperature measurement portion 140 may be embedded in a polishing platen and measure the temperature of the polishing pad 150 in a contact manner. For example, the temperature of the polishing pad 150 may be measured in a non-contact manner through a temperature sensor (e.g., an infrared sensor).

In an embodiment, the controller 160 may control the slurry supply portion 110 and the fluid supply portion 120. The controller 160 may control the temperature of the polishing pad 150 by controlling the slurry supply portion 110 and the fluid supply portion 120 based on information detected through the detector 130. Hereinafter, a method of controlling the temperature of the polishing pad 150 in each polishing of a substrate through the controller 160 is described.

In an embodiment, the substrate polishing apparatus 1 may pre-heat the polishing pad 150 before polishing a substrate. For example, the fluid supply portion 120 may spray fluid to the polishing pad 150 so that the temperature of the polishing pad 150 becomes a first temperature. The fluid sprayed onto the polishing pad 150 may be fluid of which temperature is previously controlled through the fluid temperature controller 123. Based on the temperature of the polishing pad 150 measured by the temperature measurement portion 140, the fluid temperature controller 123 may heat or cool the temperature of the fluid in the fluid supply portion 120 so that the temperature of the polishing pad 150 becomes the first temperature.

In an embodiment, the first temperature may be higher than room temperature. The first temperature may be a corresponding temperature suitable for the polishing profile of a substrate. When the polishing pad 150 is pre-heated, the period for the polishing pad 150 to reach an appropriate temperature while polishing of a substrate is in process may be reduced compared to a case in which the substrate is polished without pre-heating and accordingly, the time required for the entire polishing may be reduced.

In an embodiment, the fluid supply portion 120 may spray fluids having different phases. For example, the fluid supply portion 120 may supply fluid in a liquid state to the polishing pad 150 or spray fluid in a gaseous state.

In an embodiment, a plurality of fluid supply portions 120 may be provided. Some of the plurality of fluid supply portions 120 may supply fluid in a liquid state to the polishing pad 150 and some may supply fluid in a gaseous state to the polishing pad 150.

In an embodiment, when the plurality of fluid supply portions 120 supplies each fluid in liquid and gaseous states, the fluid supply portion 120 may sequentially dispose the fluids in liquid and gaseous states to the same portion of the polishing pad 150. Hereinafter, for convenience of description, the fluid supply portion 120 that supplies fluid in a gaseous state may be referred to as the gas supply portion and the fluid supply portion 120 that supplies fluid in a liquid state may be referred to as the liquid supply portion.

In an embodiment, when the fluid supply portion 120 includes the gas supply portion that sprays gas and the liquid supply portion that sprays liquid, the gas supply portion and the liquid supply portion may be disposed to spray liquid after first spraying gas to the same point on the polishing pad 150 polishing a substrate.

For example, the gas supply portion and the liquid supply portion may first make gas contact and then contact liquid at the same point on the polishing pad 150 polishing a substrate. In an embodiment, the gas supply portion and the liquid supply portion may be disposed side-by-side in a tangential direction with respect to the rotational direction of the rotating polishing pad 150, and the order of disposition may vary in the rotational direction of the polishing pad 150.

For example, when the polishing pad 150 rotates counterclockwise, the gas supply portion and the liquid supply portion may be sequentially disposed counterclockwise and when the polishing pad 150 rotates clockwise, the gas supply portion and the liquid supply portion may be sequentially disposed clockwise. The disposition of the gas supply portion and the liquid supply portion may be changed according to the rotation direction of the polishing pad 150.

In an embodiment, the controller 160 may determine whether the temperature of the polishing pad 150 reaches the first temperature based on the temperature measured by the temperature measurement portion 140 and then may determine whether to perform polishing of the substrate. For example, polishing may be performed when it is determined that the temperature of the polishing pad 150 is substantially equal to the first temperature.

In an embodiment, when the temperature of the polishing pad 150 is not reached the first temperature, the controller 160 may supply fluid to the polishing pad 150 through the fluid supply portion 120. For example, when the temperature of the polishing pad 150 reaches the first temperature, the controller 160 may stop supplying fluid through the fluid supply portion 120.

In an embodiment, the slurry supply portion 110 may supply the temperature-controlled slurry S to the polishing pad 150 and control the temperature of the polishing pad 150. For example, the substrate polishing apparatus 1 may control the temperature of the polishing pad 150 by controlling the temperature of the slurry S supplied from the slurry supply portion 110 based on the temperature of the polishing pad 150 measured by the temperature measurement portion 140.

In an embodiment, the substrate polishing apparatus 1 may supply the temperature-controlled slurry S to the surface of the polishing pad 150 when polishing a substrate. For example, the substrate polishing apparatus 1 may maintain the temperature of the polishing pad 150 in a set range. For example, when the temperature of the polishing pad 150 is higher than the set range or lower than the set range, the slurry temperature controller 111 may control the temperature of the slurry S to a temperature lower than or substantially the same as the set range and the slurry supply portion 110 may supply the temperature-controlled slurry S onto the polishing pad 150.

In an embodiment, the temperature in the set range of the polishing pad 150 may be higher than room temperature. The temperature in the set range may be a corresponding temperature suitable for the polishing profile of a substrate. In an embodiment, in the polishing a substrate, the temperature in the set range may be substantially the same as a pre-heated temperature.

In an embodiment, when it is determined that the thickness of a substrate reaches a set target thickness through the detector 130 while polishing of the substrate is in process, the fluid supply portion 120 may spray fluid to the polishing pad 150 so that the temperature of the polishing pad 150 becomes a second temperature lower than the first temperature. For example, fluid sprayed to the polishing pad 150 to have the second temperature lower than the first temperature may be liquid or gas. For example, when the temperature is lowered by spraying gas, liquid may be sprayed to the polishing pad 150 to reduce or prevent drying of the polishing pad 150 by spraying gas to the polishing pad 150.

In an embodiment, when gas is sprayed to the polishing pad 150, liquid of a minimum flow rate may be sprayed to the polishing pad 150 to reduce or prevent drying of the polishing pad 150 and additionally control a temperature of the polishing pad 150. Dilution of the slurry S may be minimized when liquid of a minimum flow rate is sprayed to the polishing pad 150. In this case, the sprayed liquid may be DIW.

In an embodiment, only liquid among fluids may be sprayed to the polishing pad 150 so that the temperature of the polishing pad 150 becomes the second temperature, wherein the second temperature is lower than the first temperature. For example, before spraying fluid onto the polishing pad 150 so that the temperature of the polishing pad 150 becomes the second temperature, the fluid temperature controller 123 may heat or cool the fluid.

In an embodiment, while polishing of a substrate is in process, when it is determined that the thickness of the substrate reaches a first thickness that is thicker than a target thickness through the detector 130, the fluid supply portion 120 may spray fluid to the polishing pad 150 so that the temperature of the polishing pad 150 becomes a third temperature lower, wherein the third temperature is lower than the first temperature. The detector 130 may detect whether the thickness of the substrate reaches substantially the same thickness as the first thickness, which is thicker than the target thickness.

In an embodiment, the controller 160 may determine whether the thickness of a substrate reaches the first thickness based on the thickness detected by the detector 130. The fluid to be sprayed may be liquid or fluid. When gas is sprayed, drying of the polishing pad 150 may occur, and the fluid supply portion 120 may spray liquid with gas to reduce or prevent drying of the polishing pad 150.

In an embodiment, the fluid sprayed through the fluid supply portion 120 may be fluid of which the temperature is controlled by the fluid temperature controller 123. The third temperature may be a suitable temperature corresponding to the polishing profile of a substrate.

In an embodiment, the second temperature may be lower than the third temperature. In an embodiment, the fluid supply portion 120 may supply fluid to the polishing pad 150 to make the temperature of the polishing pad 150 the third temperature, wherein the third temperature is higher than the second temperature. For example, the fluid temperature controller 123 may heat or cool the supplied fluid to make the temperature of the polishing pad 150 the third temperature.

In an embodiment, fluid supplied to the surface of the polishing pad 150 during polishing may be liquid and/or gas. In an embodiment, when the temperature of the polishing pad 150 is controlled by the slurry S during polishing, the temperature of the polishing pad 150 may be controlled by additionally supplying fluid with the temperature-controlled slurry S to the polishing pad 150.

For example, each type of additional fluid may be different. The phases of the additional fluids may be different from each other. In an embodiment, when liquid is additionally supplied with the slurry S to the surface of the polishing pad 150, the temperature of the liquid may be controlled and supplied to the surface of the polishing pad 150.

While the embodiments are described with reference to drawings, it will be apparent to one of ordinary skill in the art that various alterations and modifications in form and details may be made in these embodiments without departing from the spirit and scope of the claims and their equivalents. For example, suitable results may be achieved if the described techniques are performed in a different order and/or if components in a described system, architecture, device, or circuit are combined in a different manner and/or replaced or supplemented by other components or their equivalents.

Accordingly, other implementations are within the scope of the following claims.

What is claimed is:

1. A substrate polishing apparatus comprising:

a carrier configured to grip a substrate;

a polishing pad configured to polish a surface to be polished of the substrate gripped by the carrier while rotating; and a temperature control assembly configured to control a temperature of the polishing pad, wherein the temperature control assembly comprises:

a Deionized water (DIW) spraying module configured to spray DIW toward the polishing pad; and a guide vane configured to guide at least a portion of the DIW sprayed from the DIW spraying module to an outside of the polishing pad;

a slurry spraying module configured to spray slurry toward the polishing pad; and a housing configured to accommodate the DIW spraying module and the slurry spraying module and to which one end portion of the guide vane is coupled.

2. The substrate polishing apparatus of claim 1, wherein the one end portion of the guide vane is coupled to the other surface opposite to one surface facing the carrier in the housing and the other end portion opposite to the one end portion extends toward an outer circumferential surface of the polishing pad.

3. The substrate polishing apparatus of claim 2, wherein the guide vane comprises a wing area formed at the other end portion of the guide vane and curved in a rotational direction of the polishing pad.

4. The substrate polishing apparatus of claim 3, wherein the wing area has a shape rounded with a predetermined curvature in the rotational direction of the polishing pad.

5. The substrate polishing apparatus of claim 1, wherein the guide vane has a shape extending upward from the polishing pad.

6. The substrate polishing apparatus of claim 5, wherein the guide vane comprises a curved area formed at a lower end portion of the guide vane facing an upper surface of the polishing pad.

7. The substrate polishing apparatus of claim 6, wherein the curved area has a shape rounded with a predetermined curvature in a rotational direction of the polishing pad.

8. The substrate polishing apparatus of claim 6, wherein the curved area has a shape bent at a predetermined angle in a rotational direction of the polishing pad.

9. The substrate polishing apparatus of claim 6, wherein the curved area is formed of an elastic body comprising at least a portion of urethane, rubber, or silicon.

* * * * *